United States Patent [19]

Meisenburg et al.

[11] 4,319,982

[45] Mar. 16, 1982

[54] METHOD OF PROCESSING OIL-SHALE OR TAR SAND

[76] Inventors: Ewald Meisenburg, Höhenweg 60, 5351 Heimerzheim; Karl-Heinz Keim, Dieselstr. 43, 5047 Wesseling, both of Fed. Rep. of Germany

[21] Appl. No.: 153,894

[22] Filed: May 28, 1980

[51] Int. Cl.[3] ..... C10G 1/02

[52] U.S. Cl. ..... 208/11 R

[58] Field of Search ..... 208/11 R

[56] References Cited

U.S. PATENT DOCUMENTS 3,384,569 5/1968 Peet ..... 208/11 R 3,475,319 10/1969 MacToren ..... 208/11 R 3,565,751 2/1971 Hoekstra ..... 208/11 R 3,617,469 11/1971 Schlinger ..... 208/11 R 4,003,821 1/1977 Weil ..... 208/11 R

*Primary Examiner*—T. M. Tufariello

*Attorney, Agent, or Firm*—Howson and Howson

[57] ABSTRACT

Oil-shale or tar sand is subjected to hydrogenating carbonization and the residue is passed into a combustion zone wherein residual coke in the residue is reacted with oxygen. At least part of the heat produced in the combustion zone is used to heat the hydrogen to be used for the carbonization step.

20 Claims, 1 Drawing Figure

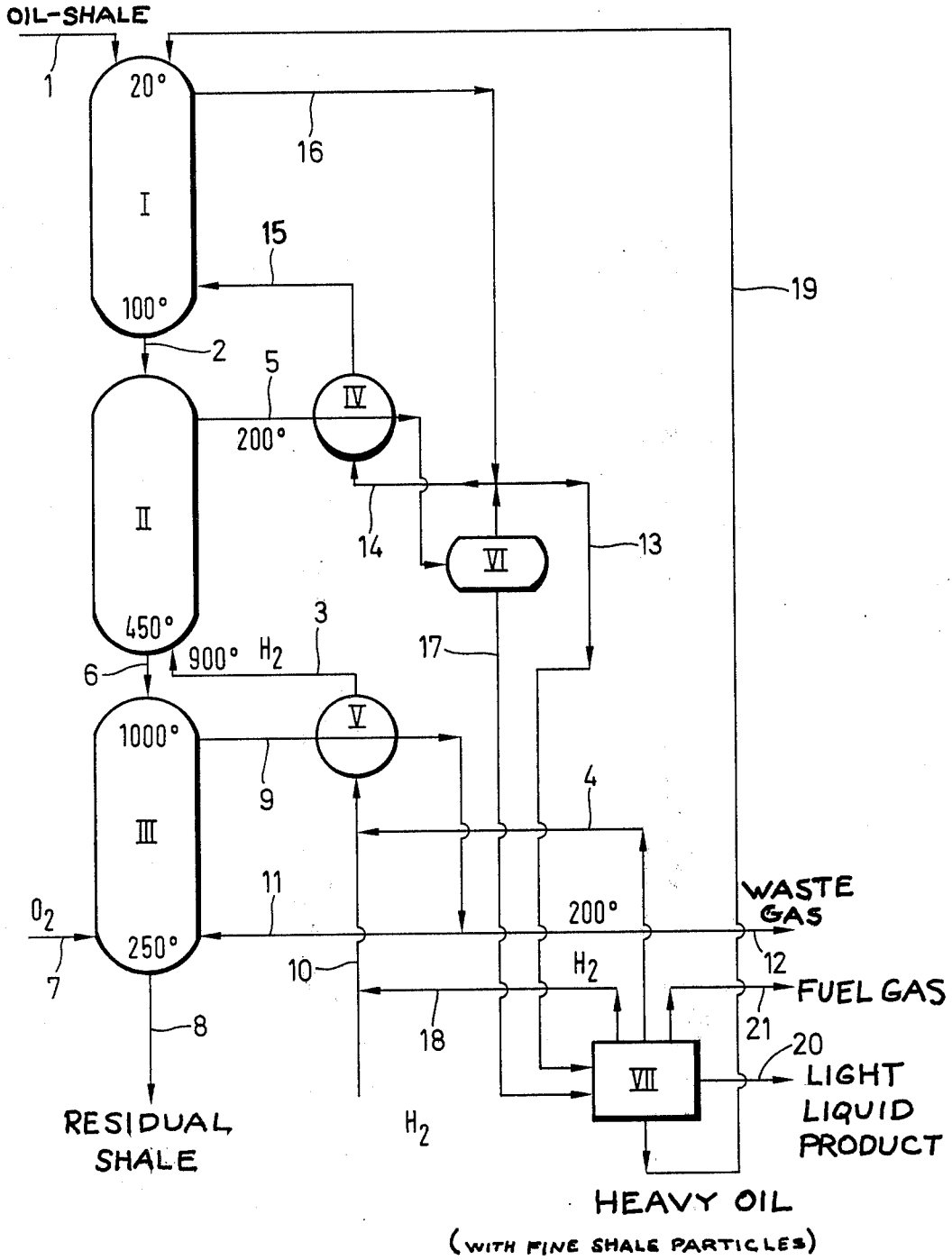
OIL-SHALE
1
20°
I
100°
16
15
19
2
5
IV
200°
II
14
VI
13
450°
3
900° H2
17
6
1000°
V
9
4
III
11
O2
200°
WASTE GAS
250°
12
7
10
H2
FUEL GAS
8
18
21
20
VII
LIGHT LIQUID PRODUCT
RESIDUAL SHALE
H2
HEAVY OIL
(WITH FINE SHALE PARTICLES)

METHOD OF PROCESSING OIL-SHALE OR TAR SAND

BACKGROUND OF THE INVENTION

A number of methods of processing oil-shale or tar sands by distillation or carbonisation in order to obtain the organic material therein have been put forward. Generally for example oil-shale is processed after preheating in a distillation or carbonation apparatus or retorting zone (in this specification the terms carbonisation and distillation are used generally interchangeably and such terms are also used interchangeably with the term "retorting"). In this operation, at temperatures of about 250° to 900° C., besides fluid organic compounds and gaseous products, there are also formed carbon-bearing solid compounds (residual coke) which generally remain in the oil-shale after the carbonisation treatment, in amounts of from 5 to 10%. These substances are usually burnt and the waste heat obtained in this way is used in various ways in the process. Thus, all or part of the hot combustion gas may be passed as a heat-carrier agent into the retorting zone for direct heat exchange (as disclosed in U.S. Pat. No. 3,297,562) or for indirect heat exchange (see U.S. Pat. No. 3,384,569), or alternatively used for preheating the oil-shale (see U.S. Pat. No. 3,475,319). The hot shale which has been burnt off and which is therefore substantially free from carbon can be used as a heat-carrier agent in the process (see German laid-open application No. 2,429,767), but this requires correspondingly expensive equipment for separating it off. Therefore, it is frequently subjected to cooling, thereby regaining the heat content therefrom, and then removed from the process.

Methods of producing shale-oil or oils from tar sand have also been disclosed, wherein the retorting operation is performed in the presence of hydrogen. The oils produced in this way are of improved quality as they are more highly saturated and contain smaller amounts of sulphur and nitrogen compounds than oils which are produced without hydrogenation. A particular advantage of such a hydrogenating carbonisation or distillation operation is that it makes it possible to produce a larger amount of the desired liquid products and a smaller amount of residual coke as, by virtue of the presence of hydrogen, the formation of unsaturated hydrocarbon polymers and carbon residues is suppressed or reduced. Various modes of operation have been proposed for carrying out the hydrogenating carbonisation or distillation step. Frequently, the method is performed using suspensions or slurries of the ground oil-shale in heavy oils resulting from the process (U.S. Pat. Nos. 3,565,751) and 3,617,469). Catalytically effective compounds are also used in this operation (U.S. Pat. No. 3,565,751). It has also been suggested that the hydrogenating treatment of oil-shale should be performed with the addition of water (see U.S. Pat. No. 3,617,472). This method provides a comparatively high yield in respect of the products desired and such a low residual carbon content, about 3%, in the processed shale, that it did not seem worthwhile to burn off the residual carbon content. It is therefore removed from the process after cooling.

SUMMARY OF THE INVENTION

An object of the invention is to provide a method of hydrogenating carbonisation of oil-shale or tar sand, which makes use of waste heat produced in the carbonisation step.

A further object of the invention is to provide an oil-shale or tar sand carbonisation method which can be carried out in standard design equipment while enjoying enhanced economic viability.

A still further object of the invention is to provide for the hydrogenating carbonisation or distillation of oil-shale or tar sand, which involves a reduced consumption of hydrogen.

Another object is to provide a method for the hydrogenating carbonisation of oil-shale or tar sand as equally alternative materials for the method.

It has now been found that the economic viability and efficiency of the hydrogenating carbonation of oil-shale or tar sand can be improved if the waste heat which is produced in the process is used in a certain manner.

Accordingly, in a method of processing oil-shale or tar sand, the oil-shale or tar sand is subjected to retorting in the presence of hydrogen, at a temperature of from about 380° to about 550° C. and a pressure of from about 10 to about 80 bars, with the exclusion of oxygen, in a retorting zone. The residues of the oil-shale or tar sand after the carbonisation or distillation step are passed into a combustion zone in which residual coke remaining in the residues is reacted in the presence of oxygen. At least part of the heat produced in the combustion zone is used for heating hydrogen to be introduced into the retorting zone.

The method according to the invention can be generally carried out in conventional retorting equipment, using known procedures.

In the method of the invention, the oil-shale is reduced to the desired particle size and introduced in known manner into the pressurised reaction zones which may be arranged in any suitable manner. If desired, the oil-shale may also be used in the form of a suspension or slurry in a high-boiling oil fraction which originates from the process. Generally, operation in the retorting process is at a temperature in an approximate range of 380° to 550° C., more particularly 430° to 500° C., at a pressure in an approximate range of 10 to 80 bars, more particularly 30 to 40 bars, with the hydrogen partial pressure being selected at a sufficiently high level to produce the desired hydrogenation effect. The residence times in the retorting zone are generally up to about 60 minutes or more.

It may be advantageous, in the carbonisation operation, to add water or water vapour, and optionally also carbon dioxide, in which case amounts of from about 0.05 to 0.5 tonne of water for each tonne of oil-shale will generally be used. In this way for example the liberation of carbon dioxide from inorganic carbonates can be reduced and thus it is possible to achieve a saving in respect of the hydrogen which otherwise would react with the carbon dioxide. It is then also possible to reduce the amount of hydrogen to be used as scavenge gas.

The carbonisation or distillation of oil-shale or tar sand is generally effected in such a way that the residual coke remaining in the processed residue is less than about 5%, preferably less than 3%. The reaction of this residual coke in the combustion zone which can be operated at normal pressure or under an elevated pressure can be effected by means of an oxygen-bearing agent such as air. As in this case the waste gas contains considerable amounts of nitrogen, it will be taken off at the upper region of the combustion zone and will not be passed through the distillation zone. The heat of the waste gas which is for example at a temperature of about 1000° C. is firstly utilised, at least in part, for heating the hydrogen to be used in the retorting zone, preferably in an indirect heat-exchange mode, with the remaining heat being extracted and put to use in the usual way. It is advantageous however to use pure oxygen instead of air for reacting the residual coke. In this case the waste gas is also taken off at the top part of the combustion zone and used for heating the hydrogen. A part of the waste gas which is cooled in that manner is advantageously recycled to the combustion zone as a dilution and scavenge gas, as otherwise the temperature in that zone may rise to an undesirably high level. The shale or tar sand residue which is freed of residual coke is removed from the process, possibly after putting the residual heat still present therein to use, in known manner.

The operation of reacting the residual coke may also be effected in such a way that hydrogen which has possibly been preheated is introduced into the combustion zone, in addition to the pure oxygen, in which case operation in the combustion zone is under approximately the same pressure as the pressure in the distillation zone. In this operation, the amount of oxygen is controlled in such a way that a predetermined part of the hydrogen reacts with the oxygen in the combustion zone to form water. The heat which is produced in this exothermic reaction is used for heating the non-reacted hydrogen component which is introduced as a hydrogenating gas into the distillation zone. At the high temperatures in the combustion zone, the water formed is substantially reacted with the residual coke in water gas and conversion reactions, forming hydrogen, methane, carbon monoxide and carbon dioxide, whereby the balance sheet, in regard to hydrogen, of the process is improved. By suitable adjustment of the amounts of hydrogen and oxygen supplied, and optionally by additionally supplying water or methane, it is possible to provide that the residual coke is virtually completely reacted. The gas mixture produced in this way can be introduced directly into the distillation zone. The shale or tar sand residue is removed from the process, possibly after making use of the heat in known manner.

The distillation products obtained may be processed and used in the usual manner. Hydrogen and water vapour or water are separated off and recycled to the process. The fresh hydrogen required can be obtained for example by means of known processes from the distillation gases. When the method uses pure oxygen in the combustion zone, it enjoys inter alia the advantage that the waste gas from the combustion zone has a relatively high sulphur content which makes it possible for the sulphur to be extracted for example by the usual Claus process. This is generally not possible when air is used as an oxygen carrier, as in that case the flue gas is excessively diluted or rarefied and thus desulphurisation must be carried out by means of a process in the nature of flue gas desulphurisation, which is less economically viable.

It may be advantageous for the high-boiling distillation or carbonisation products, for example with an initial boiling temperature of between about 400° and 500° C., to be recycled to the distillation zone. If this is done, it is no longer necessary for the fine shale particles which are entrained therewith to be separated to the maximum possible extent, before further processing. The waste heat of the distillation gas may be utilised in the usual manner, advantageously also for preheating the tar sand or oil-shale to be processed. In this case for example the distillation gas is cooled in a heat exchanger and the products which condense out are then separated off. A part of the residual gas produced in this way is taken off and circulated through the heat exchanger in which it absorbs heat from the hot distillation gas which has not yet cooled down, and is then passed as a heat carrier agent through the preheating zone.

The method according to the invention makes it possible for distillation or low-temperature carbonisation of oil-shale or tar sand to be carried out in a particularly economic manner.

BRIEF DESCRIPTION OF THE DRAWING

Reference will now be made to the accompanying drawing which shows the basic principle of an embodiment of the method of the invention, accessory equipment having been omitted from the drawing for the sake of enhanced clarity.

DESCRIPTION OF A PREFERRED EMBODIMENT

Crushed oil-shale is introduced into a preheating zone I by way of conduit 1. After the oil-shale has been heated to about 100° C., it passes by way of duct 2 into a retorting zone II which is operated at a temperature of about 450° C. and a pressure of about 30 bars. This zone II is supplied with water vapour and hydrogen required for the hydrogenation action, by way of conduit 3. The distillation or vaporous products, produced in zone II are taken off by way of conduit 5. The shale which has been substantially distilled off passes by way of conduit 6 into a combustion zone III. In that zone, residual coke which has remained in the shale is reacted with oxygen which is supplied by way of conduit 7, the temperature in zone III rising to about 1000° C. The residual shale which is thus virtually free of carbon is removed by way of conduit 8. The flue gas formed in combustion zone III is taken off by way of conduit 9 and used in a heat exchanger V for heating the water vapour and hydrogen which are supplied to zone II by way of conduit 10 and conduit 4 respectively, and which are then passed at a temperature of about 900° C. by way of above-mentioned conduit 3 into zone II. A part of the waste gas from combustion zone III is removed by way of conduit 12.

The distillation or vaporous products which are taken from zone II by way of conduit 5 are firstly cooled in heat exchanger IV and then pass into separator VI where the gaseous constituents are separated off. They are removed by way of conduit 13, unless they are passed by way of conduit 14 and, after being heated in heat exchanger IV, by way of conduit 15, into the preheating zone I which they leave again by way of conduit 16. The excess gaseous products which are separated off in separator VI are fed to processing step VII by way of conduit 13 while the remaining products are passed to processing step VII by way of conduit 17. In processing step VII, hydrogen which has not been consumed is recycled by way of conduit 18 and water or water vapour is produced, for recycling by way of conduit 4. The distillation products are separated into a high-boiling heavy oil containing fine shale particles, which is passed by way of conduit 19 into the preheating zone I, lower-boiling products in the gasoline and middle oil boiling range, which are passed by way of conduit 20 to a processing step (not shown) for processing to produce desired product qualities, and a heating or fuel gas which is taken off by way of conduit 21 and which can be put to any appropriate uses.

Although the above-given description relating to the drawing refers to oil-shale as the starting material, it will be appreciated that the tar sand will be processed in corresponding fashion.

A more specific Example of the method will now be described:

EXAMPLE

An oil-shale comprising:

| | |
|---|---|
| C | 13.2% by weight |
| H | 1.9% by weight |
| S | 3.9% by weight |
| Fischer oil content | 7.1% by weight |

was crushed to a particle size of about 2 to 3 mm, and subjected to hydrogenating distillation or carbonisation at a temperature of about 425° to 450° C. Result:

| Distillation pressure | bar | 15 | 30 | 60 |
|---|---|---|---|---|
| Yields of oil | % by weight | 9.0 | 10.7 | 11.1 |
| gas | " | 3.4 | 2.9 | 3.1 |
| water | " | 5.1 | 4.5 | 4.2 |
| residual shale | " | 82.5 | 82.1 | 81.6 |
| oil with respect to Fischer analysis | " | 111 | 151 | 156 |
| C in the residual shale before reaction | " | 3.3 | 2.9 | 2.7 |
| C in the shale after reaction | " | 0.2 | 0.1 | 0.1 |

Various modifications may of course be made in the abovedescribed method and also operating equipment without thereby departing from the spirit and scope of this invention.

What is claimed is:

1. A method of retorting oil shale to produce shale oil in which crushed oil shale flows serially downward through at least a pre-heating zone, a retorting zone, and a combustion zone which comprises:

(a) generating flue gas at an elevated temperature by burning in said combustion zone carbonaceous material on the spent oil shale from said retorting zone in the presence of an oxygen-containing gas introduced to said combustion zone;

(b) withdrawing the flue gas from said combustion zone and recycling at least a portion thereof to said combustion zone;

(c) introducing a hydrogen-containing gas to said retorting zone after heating same a sufficient amount to provide heat for retorting pre-heated oil shale;

(d) said hydrogen-containing gas being heated by passage in indirect heat exchange with said flue gas withdrawn from said combustion zone;

(e) withdrawing vaporous product from said retorting zone and cooling and condensing it to separate therefrom a gaseous product, a light liquid product, and a heavy oil containing fine shale particles;

(f) introducing a portion of said gaseous product to said pre-heating zone after heating same a sufficient amount to pre-heat said oil shale; and (g) recycling at least a portion of said gaseous product withdrawn from said pre-heating zone to said pre-heating zone.

2. A method as set forth in claim 1 wherein said temperature is from about 430° to 500° C.

3. A method as set forth in claim 1 wherein said pressure is from about 30 to 40 bars.

4. A method as set forth in claim 1 wherein the residence time of the oil-shale in the distillation zone is up to about 60 minutes.

5. A method as set forth in claim 1 wherein water vapour is additionally introduced into the carbonisation zone.

6. A method as set forth in claim 1 wherein carbon dioxide is additionally introduced into the carbonisation zone.

7. A method as set forth in claim 1 wherein the carbonisation products which have a boiling point of above about 400° C. are recycled to the carbonisation zone.

8. A method according to claim 1 in which said gaseous product prior to being introduced to said pre-heating zone is heated by indirect heat exchange with the vaporous product withdrawn from said retorting zone.

9. A method according to claim 1 in which said heavy oil containing fine shale particles is introduced to said retorting zone.

10. A method according to claim 1 in which said high-burning heavy oil containing fine shale particles is introduced to said pre-heating zone.

11. A method of retorting tar sand to produce sand oil in which tar sand flows serially downward through at least a pre-heating zone, a retorting zone, and a combustion zone which comprises:

(a) generating flue gas at an elevated temperature by burning in said combustion zone carbonaceous material on the spent tar sand from said retorting zone in the presence of an oxygen-containing gas introduced to said combustion zone;

(b) withdrawing the flue gas from said combustion zone and recycling at least a portion thereof to said combustion zone;

(c) introducing a hydrogen-containing gas to said retorting zone after heating same a sufficient amount to provide heat for retorting pre-heated tar sand;

(d) said hydrogen-containing gas being heated by passage in indirect heat exchange with said flue gas withdrawn from said combustion zone;

(e) withdrawing vaporous product from said retorting zone and cooling and condensing it to separate therefrom a gaseous product, a light liquid product, and a heavy oil;

(f) introducing a portion of said gaseous product to said pre-heating zone after heating same a sufficient amount to pre-heat said tar sand; and (g) recycling at least a portion of said gaseous product withdrawn from said pre-heating zone to said pre-heating zone.

12. A method as set forth in claim 11 wherein said temperature is from about 430° to 500° C.

13. A method as set forth in claim 12 wherein said pressure is from about 30 to 40 bars.

14. A method as set forth in claim 11 wherein the residence time of the tar sand in the carbonisation zone is up to about 60 minutes.

15. A method as set forth in claim 11 wherein water vapour is additionally introduced into the carbonisation zone.

16. A method as set forth in claim 11 wherein carbon dioxide is additionally introduced into the carbonisation zone.

17. A method as set forth in claim 11 wherein the carbonisation products which have a boiling point of above about 400° C. are recycled to the carbonisation zone.

18. A method according to claim 11 in which said gaseous product prior to being introduced to said pre-heating zone is heated by indirect heat exchange with the vaporous product withdrawn from said retorting zone.

19. A method according to claim 11 in which said heavy oil is introduced to said retorting zone.

20. A method according to claim 11 in which said high-burning heavy oil is introduced to said pre-heating zone.

* * * * *